US005260160A

United States Patent [19]

Aoki et al.

[11] Patent Number: 5,260,160

[45] Date of Patent: Nov. 9, 1993

[54] MAGNETIC COMPOSITION AND METHOD FOR DEVELOPING ELECTROSTATIC LATENT IMAGES

[75] Inventors: Kazuo Aoki; Akira Kakinuma; Megumi Saito; Motohiko Makino, all of Akita, Japan

[73] Assignee: TDK Corporation, Tokyo, Japan

[21] Appl. No.: 1,219

[22] Filed: Jan. 6, 1993

Related U.S. Application Data

[63] Continuation of Ser. No. 622,169, Dec. 3, 1990, abandoned, which is a continuation of Ser. No. 400,765, Aug. 30, 1989, abandoned.

[30] Foreign Application Priority Data

Aug. 30, 1988 [JP] Japan ..... 63-213812
Jun. 15, 1989 [JP] Japan ..... 1-152978

[51] Int. Cl.[5] ..... G03G 9/083; G03G 13/09

[52] U.S. Cl. ..... 430/106.6; 430/111; 430/122

[58] Field of Search ..... 430/106.6, 111, 122

[56] References Cited

U.S. PATENT DOCUMENTS 2,618,551 11/1952 Walkup ..... 430/107 X
3,060,051 10/1962 Johnson ..... 430/124
3,165,420 1/1965 Tomanek et al. ..... 430/110
3,345,294 10/1967 Cooper ..... 430/106.6 X
4,436,413 3/1984 Oka ..... 430/122 X
4,482,621 11/1984 Kashiwagi ..... 430/107
4,640,880 2/1987 Kawanishi et al. ..... 430/106.6
4,675,268 6/1987 Kishi et al. ..... 430/126
5,053,305 10/1991 Aoki et al. ..... 430/106.6 X

FOREIGN PATENT DOCUMENTS 0125606 11/1984 European Pat. Off. .
61-149970 7/1986 Japan .
61-289359 12/1986 Japan .
2074745 11/1981 United Kingdom .

OTHER PUBLICATIONS

Patent Abstracts of Japan, vol. 13, No. 93 (P-838) (3441), Mar. 6, 1989; & JP-A-63 276 065 (Casio Electronics Mfg. Co., Ltd.) Nov. 14, 1988.

*Primary Examiner*—Roland Martin
*Attorney, Agent, or Firm*—Oblon, Spivak, McClelland, Maier & Neustadt

[57] ABSTRACT

A composition for developing electrostatic latent images in electrographic printing or copying machinery is provided in which 10% to less than 40% by weight of a carrier having a mean particle diameter of from 10 to 35 μm is blended with a magnetic toner comprising magnetic powder and a resin. Conventional charge control agents, especially metal complexes of azo dyes and Nigrosine dyes should be excluded from the magnetic toner.

9 Claims, 1 Drawing Sheet

MAGNETIC COMPOSITION AND METHOD FOR DEVELOPING ELECTROSTATIC LATENT IMAGES

This application is a continuation of application Ser. No. 07/622,169, filed on Dec. 3, 1990, which is a continuation of application Ser. No. 07/400,765, filed on Aug. 30, 1989, both now abandoned.

BACKGROUND OF THE INVENTION

This invention relates to an electrostatic latent image developer comprising a magnetic toner and a carrier and a method for developing an electrostatic latent image using the developer.

For the development of electrostatic latent images, mono component developers using magnetic toner are well known in the art. Triboelectric magnetic toners comprising a magnetic toner and a charge control agent are also known as disclosed in Japanese Patent Application Kokai Nos. 48754/1980, 45555/1982, 45556/1982, and 45557/1982. These mono component toners suffer from agglomeration due to static charges which causes image defects such as white streaks.

Techniques for preventing such toner agglomeration are disclosed in Japanese Patent Application Kokai Nos. 121054/1984, 182464/1984, 210450/1984, 210466/1984, 216149/1984, 42163/1987, 275280/1987, and 294259/1987. These developing compositions are prepared by adding a carrier to a triboelectric magnetic toner having internally added thereto a charge control agent, for example, a chromium complex of a monoazo dye such as Bontron S-34 (manufactured by Orient Chemical K.K.) and a Nigrosine dye such as Bontron N-01 (manufactured by Orient Chemical K.K.). The carrier is added in amounts of 60 to 90% by weight and 30 to 90% by weight in Japanese Patent Application Kokai Nos. 42163/1987 and 294259/1987, respectively. Japanese Patent Application Kokai No. 182464/1984 indicates to add minor amounts of carrier.

In these patent applications, it is generally believed that the composition should be carrier rich in order to prevent toner scattering, to reduce the amount of toner spent, and to extend the life of carrier. For this reason, more than 50% by weight of carrier is mixed with the toner in all the examples of these patent applications.

Japanese Patent Application Kokai No. 162563/1984 discloses an example in which a developing composition is prepared by adding 90 to 60% by weight of a carrier to a triboelectric magnetic toner having internally added thereto a charge control agent in the form of Aizen Spilon Black TRH (manufactured by Hodogaya Chemical K.K.) which is a monoazo dye chromium complex. It also discloses a comparative example in which a developing composition is prepared by adding 40% by weight of a carrier to a similar triboelectric magnetic toner, which is reported to undergo background fogging due to toner scattering and a lowering of copy image density.

In the developing compositions of Japanese Patent Application Kokai No. 182464/1984 and other patent applications, the initial load of carrier must be increased. During continuous printing, the toner is replenished whereupon the toner is not immediately distributed over the carrier, resulting in reduced image density and failing to reproduce copies of constant quality.

If the initial load of toner is increased in such developing composition, the content of carrier would be 30 to 40% by weight or lower. With the use of a triboelectric toner having internally added thereto a monoazo dye metal complex or a Nigrosine dye, the reduced carrier content would cause background fogging due to toner scattering and a reduction in copy image density.

SUMMARY OF THE INVENTION

Therefore, an object of the present invention is to provide an improved electrostatic latent image developing composition which is devoid of toner agglomeration, white streak formation, carrier drag-out, and toner scattering, which can achieve an increased image density and resolution, and which undergoes little change in image qualities including density, resolution and fog upon continuous development of plural copies.

Another object of the present invention is to provide a developing method using the electrostatic latent image developing composition.

According to a first aspect of the present invention, there is provided an electrostatic latent image developing composition comprising a magnetic toner comprising magnetic particles and a resin, the magnetic toner being free of azo dye metal complexes and Nigrosine dyes, and 10% to less than 40% by weight of a carrier having a mean particle diameter of from 10 to 35 μm.

Since the magnetic toner used herein is free of any metal complexes of azo dyes or Nigrosine dyes for internal addition, no toner scattering occurs even when the initial load of toner in the developing composition is increased in order to improve the image stability upon continuous printing.

According to a second aspect of the present invention, there is provided a method for developing an electrostatic latent image using a developing unit including a magnet, a developing sleeve mounted for relative rotation on the magnet, and a photoconductor disposed in proximity to the sleeve and adapted to have a latent image born thereon. The method includes the steps of: charging the developing unit with an electrostatic latent image developing composition as defined above, and causing relative rotation of the magnet and the developing sleeve, thereby developing the latent image on the photoconductor with the developing composition. Since only the toner is consumed with the progress of development, the toner component is replenished at intervals in the electrostatographic process.

BRIEF DESCRIPTION OF THE DRAWING

The above and other objects, features, and advantages of the present invention will be better understood from the following description taken in conjunction with the accompanying drawing, in which.

the only figure.

DETAILED DESCRIPTION OF THE INVENTION

Figure 1:
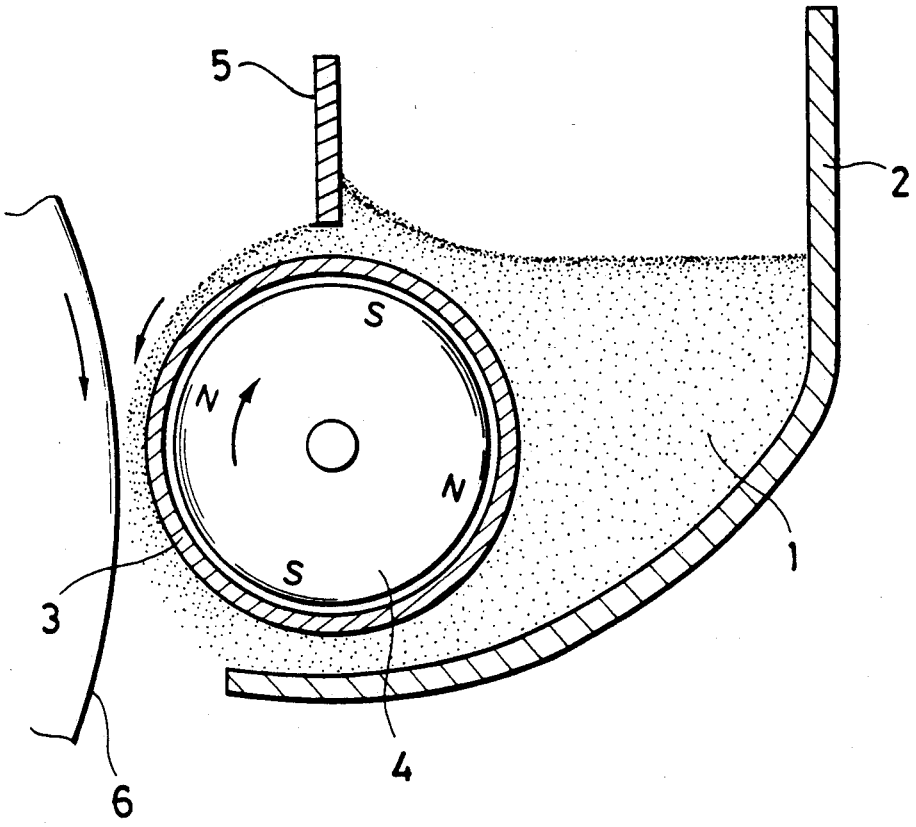
FIG. 1 is a schematic illustration of a developing unit.

The electrostatic latent image developing composition of the invention includes a magnetic toner and a carrier as defined above.

The carrier used in the developing composition of the invention is a particulate carrier having a mean particle diameter of from 10 to 35 μm, preferably 15 to 30 μm. If the mean particle diameter of the carrier is in excess of 35 μm, resolution would lower and the toner would readily scatter to cause considerable soiling of the developing unit. If the mean particle diameter of the carrier is less than 10 μm, more carrier would be dragged out.

The mean particle diameter used herein is a 50% particle diameter determined upon calculation of volume average particle diameter from measurements by the microtrack method. It is calculated from the data obtained by dispersing a particulate sample in water with the aid of a dispersant and carrying out measurement on a volume basis using a micro-track type STD 7991-0 (Leeds & Northrup Co.).

The identity of the carrier is not critical to the invention. The carrier may be formed of various soft magnetic materials such as iron, magnetite and various ferrites. The ferrites used herein may be of various well-known compositions include Mg-Cu-Zn ferrite, Ni-Zn ferrite, and Cu-Zn ferrite.

The carrier may have a coating of acrylic resin, silicone resin or fluoride resin, if desired. The carrier may contain a binder such as a polyester resin and styrene-acrylic resin like the toner which will be described later.

The carrier may have a coercive force Hc of up to 50 oersted (Oe) upon magnetization at 5000 Oe, preferably up to 20 Oe at 5000 Oe. Carriers with a coercive force of more than 50 Oe would sometimes be unsatisfactory in carrying the toner.

The carrier may have a maximum magnetization $\sigma_m$ of 25 to 220 emu/g, preferably 30 to 210 emu/g upon magnetization at 5000 Oe. Particularly, ferrite carriers preferably have a maximum magnetization $\sigma_m$ of 30 to 100 emu/g. With a maximum magnetization $\sigma_m$ of less than 25 emu/g, carrier drag-out will often occur. If the maximum magnetization $\sigma_m$ of the carrier is more than 220 emu/g, the resulting magnetic brush would form a hard head causing scratches on the photoconductor. It is to be noted that these magnetic properties may be measured by means of a vibration magnetometer.

The carrier may preferably have an electric resistance of at least $1\times10^5$ Ω, more preferably $1\times10^6$ to $2\times10^{12}$ Ω upon 100 volt application. With a resistance of lower than $1\times10^5$ Ω, more brush streaks would appear. An extremely high resistance is undesirable because a desired density is not readily available. The electric resistance is measured by placing 0.2 grams of the carrier between 7-mm spaced parallel metal plates which are interposed between opposed magnets. A ultra-insulation resistance tester Model SM-10E or SM-5 (manufactured by Toa Denpa K.K.) is connected to the plates and the voltage applied across the carrier is progressively increased from 10 V to 1000 V. The reading is considered to be an electric resistance.

The carrier may preferably have a bulk density of from 2.1 to 3.3 g/cm$^3$, more preferably from 2.1 to 2.8 g/cm$^3$ as measured according to JIS Z2504.

The carrier may be prepared in various ways. For example, a soft magnetic material is introduced into a mixer, agitated in a slurry state, and then finely divided in an attritor. The material is granulated and dried by means of a spray dryer and classified by a sifter to obtain a fraction of a certain particle size. The material is sintered in an electric furnace, then crushed by a crusher, and disintegrated in a vibratory manner. Then the material is classified by means of a sifter and an air classifier so as to obtain a fraction of a desired particle size. If desired, the resulting particles are further coated by means of a coating machine, heat treated, and classified again, obtaining a coated carrier. Any other well-known methods may be used to prepare the particulate carrier.

The magnetic toner used herein may preferably have a mean particle diameter of from 6 to 25 μm, more preferably from 8 to 20 μm. If the toner has a mean particle diameter of less than 6 μm, the developing composition would become less free flowing and tend to cake or adhere to the sleeve. If the toner has a mean particle diameter of more than 25 μm, resolution and fixation would deteriorate. The mean particle diameter of the toner is a 50% mean particle diameter obtained by calculation of the volume particle diameter from measurements by the Coulter counter method. The Coulter counter method carries out measurement on a volume basis using a Coulter counter Model TA-II having an aperture diameter of 100 μm (manufactured by Coulter Electronics) and Isoton II (manufactured by Coulter Electronics) as the electrolytic solution. As to the particle diameter distribution, it is preferred that the proportion of larger particles having a diameter of at least $2\bar{d}$ is up to about 5% and the proportion of smaller particles having a diameter of up to $\bar{d}/2$ is up to about 5% provided that d is a mean particle diameter.

The magnetic toner contains magnetic powder and resin.

The magnetic powder may be selected from conventional well-known magnetic materials including metals such as iron, manganese, cobalt, nickel, and chromium, and their alloys, metal oxides such as chromium oxide, iron sesquioxide, and tri-iron tetroxide, and ferrites represented by the general formula: $MO\text{-}Fe_2O_3$ wherein M is at least one metal selected from the group consisting of mono- and divalent metals such as Fe, Mn, Co, Ni, Mg, Zn, Cd, Ba, and Li.

The magnetic powder preferably has a mean particle diameter of from 0.01 to 10 μm, more preferably from 0.05 to 3 μm.

In the practice of the invention, the toner preferably contains two or more types of magnetic powder. The two or more types of magnetic powder are preferably those having different coercive forces Hc. For example, a mixture of a first magnetic powder having a coercive force Hc of 60 to 150 Oe and a second magnetic powder having a coercive force Hc of 130 to 300 Oe at 5000 Oe is preferred. In such a mixture, lower and higher coercive force magnetic powders are preferably blended in a weight ratio of from 1:4 to 4:1, more preferably from 1:2 to 2:1. The mixture preferably has a coercive force Hc of from 80 to 220 Oe at 5000 Oe. Preferably, the average coercive force of the higher coercive force magnetic powder is 100–170 Oe higher than that of the lower coercive force magnetic powder.

The two or more magnetic powders used in admixture may preferably have a maximum magnetization $\Omega_m$ of 50 to 100 emu/g upon magnetization at 5000 Oe.

As a result of mixing of magnetic powders having different properties, the particulate magnetic toner shows magnetic properties as described later and a benefit that an electrostatic latent image is faithfully reproduced at the maximum resolution because of controlled scattering of toner to white background around printed sites. Although the reason why a mixture of two or more magnetic powders is effective in controlling the toner scattering is not understood, such a benefit is not available with a single magnetic powder which has a coercive force corresponding to that of the magnetic powder mixture. With the use of a mixture of two or more magnetic powders, toner scattering is controlled so that the developing unit is soiled to a minimum extent.

Each of the two or more magnetic powders used in admixture preferably has a mean particle diameter of from 0.01 to 10 μm, more preferably from 0.05 to 3 μm.

The other component of the toner is a resin which is preferably selected from styrene copolymer resins.

The styrene copolymer resins are those obtained by copolymerization of a styrenic monomer and a copolymerizable vinyl monomer. Examples of the copolymerizable monomers include styrene and its derivatives; acrylic and methacrylic esters such as methyl acrylate, ethyl acrylate, isopropyl acrylate, n-butyl acrylate, α-ethylhexyl acrylate, α-hydroxyethyl acrylate, hydroxypropyl acrylate, methyl methacrylate, ethyl methacrylate, isopropyl methacrylate, n-butyl methacrylate, isobutyl methacrylate, n-hexyl methacrylate, lauryl methacrylate, α-hydroxyethyl methacrylate, and hydroxypropyl methacrylate; amides such as acrylamide, diacetone acrylamide, and N-methylol acrylamide; and vinyl esters, ethylenic olefins, and ethylenic unsaturated carboxylic acids.

Polyester resins are also useful. The polyester resins are those obtained by polycondensation of a polybasic acid component and a polyhydric alcohol component. Examples of the polybasic acid include aliphatic, aromatic and cycloaliphatic polycarboxylic acids such as oxalic acid, malonic acid, succinic acid, glutaric acid, adipic acid, pimelic acid, suberic acid, azelaic acid, sebacic acid, maleic acid, fumaric acid, phthalic acid, isophthalic acid, terephthalic acid, 1,4-cyclohexane dicarboxylic acid, and 1,3-cyclohexane dicarboxylic acid, and anhydrides thereof.

Examples of the polyhydric alcohol include aliphatic, aromatic and cycloaliphatic polyalcohols such as ethylene glycol, propylene glycol, trimethylene glycol, 1,4-butane diol, 1,5-pentane diol, 1,6-hexane diol, 1,7-heptane diol, 1,8-octane diol, 1,9-nonane diol, 1,10-decane diol, pinacol, hydrobenzoin, benzpinacol, cyclopentane-1,2-diol, cyclohexane-1,2-diol, and cyclohexane-1,4-diol.

Other useful resins include epoxy resins, silicone resins, fluoride resins, polyamide resins, acrylic resins, polyurethene resins, polyether resins, polyvinyl alcohol resins, polyethylene, ethylene-vinyl acetate copolymers, and polypropylene.

The resins may be used alone or in admixture of two or more if desired. These resins may be prepared by any of well-known conventional polymerization methods such as solution polymerization, suspension polymerization, emulsion polymerization, mass polymerization, thermal polymerization, interfacial polymerization, high pressure polymerization, and low pressure polymerization, and any appropriate combination thereof.

When the magnetic toner is a mixture of the resin and the magnetic powder, the toner preferably contains 10 to 70% by weight, more preferably 20 to 60% by weight of the magnetic powder. If the magnetic powder content of the toner is less than 10% by weight, the toner would be insufficient to convey the magnetic forces of the magnets in the developing unit, resulting in aggravated fog and toner scattering. With a magnetic powder content of more than 70% by weight, the toner shows poor fixation.

The magnetic toner may further contain various internal additives.

A typical internal additive is a group of waxes. The wax is added for the purpose of preventing the so-called offset development as occurring upon fixation with a fixing roll. The wax may be selected from low molecular weight polyethylene and polypropylene, metals salts of fatty acids, and silicone fluids. Illustrative examples are polyethylenes such as Hiwax 100P and Hiwax 110P (commercially available from Mitsui Petro-Chemical K.K.), polypropylenes such as Biscol 550P and Biscol 330P (commercially available from Sanyo Chemicals K.K.), fatty acid metal salts such as Zinc Stearate 601 and Zinc Stearate CP (commercially available from Nitto Chemicals K.K.), and silicone fluids such as Silicone Oil KF96 and Silicone Oil KF69H (commercially available from Shin-Etsu Silicone K.K.).

A fluoride resin is another useful release agent having a similar function.

The internal additive having a release function may preferably be added in amounts of 0.1 to 10 parts, more preferably 1 to 5 parts by weight per 100 parts by weight of the toner.

Other internal additives are tone and resistance control agents, for example, inorganic and organic pigments such as Carbon Black MA-100 (commercially available from Mitsubishi Chemicals K.K.), Kezchen Black EC-600JD (commercially available from Lion Akzo K.K.), 671 Milori Blue (commercially available from Dainichi Seika K.K.), and conductive titanium oxide (commercially available from Titan Industry K.K.). These additives may preferably be added in amounts of 0.1 to 10 parts, more preferably 0.1 to 5 parts by weight per 100 parts by weight of the toner.

Flow and resistance modifiers which will be described later as external additives may also be used as internal additives.

As described above, the toner particles each contain the magnetic powder and the resin and if desired, internal additives such as waxes and pigments, but do not contain charge control agents in the form of metal complexes, especially chromium complexes of azo dyes, especially monoazo dyes and Nigrosine dyes.

The initial proportion of toner and carrier defined according to the invention ensures the stability of density and quality of images upon serial duplication of plural copies because the toner system free of metal complexes of azo dyes and Nigrosine dyes among other charge control agents is devoid of toner scattering, background fogging, density lowering, and toner spending.

The metal complexes of monoazo dyes which should be excluded from the toner of the invention are, for example, of the following structural formula:

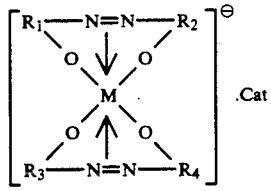

wherein $R_1$, $R_2$, $R_3$ and $R_4$ are independently aromatic polar groups, M is a metal, and Cat is a cation.

Other well-known azo dye metal complexes should also be excluded from the toner of the invention.

The Nigrosine dyes which should be excluded from the toner of the invention are well known in the art.

Also dyes of metal complex type should preferably be excluded from the toner of the invention.

Examples of the metal complexes of azo dyes and Nigrosine dyes which should be excluded from the toner of the invention include Aizen Spilon Black TRH, T-37 and T-77 (commercially available from Hodogaya Chemical K.K.), Bontron S-34, S-31, S-32, E-81, E-82, N-01, N-02, N-03, N-04, N-05 and N-07 (commercially available from Orient Chemical K.K.), and Kayaset Black T-2, T-3 and 004 (commercially available from Nihon Kayaku K.K.).

Although the charge control agents other than the metal complexes of azo dyes and Nigrosine dyes, particularly charge control agents in the form of dyes are not as strictly inhibited from internal addition to the toner as the metal complexes of azo dyes and Nigrosine dyes, they should preferably be excluded from the toner of the invention because they have similar tendency. Examples of the charge control agent of dye type which should preferably be excluded from the toner are quaternary ammonium salt dyes such as Bontron P-51 (commercially available from Orient Chemical K.K.) and Kayaset Charge N-1 (commercially available from Nihon Kayaku K.K.).

The toner may have externally added thereto resistance modifiers, tone control agents or coloring agents, and flow modifiers.

Examples of the external additive include powder inorganic materials, for example, colloidal silica, metal oxides such as titanium oxide, zinc oxide, and alumina and silicon carbide, calcium carbonate, barium carbonate, and calcium silicate;

bead polymers such as PMMA, polyethylene, nylon, silicon resins, phenol resins, benzoguanamine resins, and polyester;

powder fluoride organic materials such as ethylene tetrafluoride, polytetrafluoroethylene, and fluorinated vinylidene;

metal salts of fatty acids such as zinc stearate and magnesium stearate;

black pigments such as carbon black, acetylene black, channel black, and aniline black;

yellow pigments such as Dialite Yellow GR and Variolyl Yellow 1090;

red pigments such as Permanent Red E5B and Rhodamine 2B;

blue pigments such as copper phthalocyanine and cobalt blue green pigments such as Pigment Green B; and orange pigments such as Pyrazolone Orange.

These external additives may be used alone or in admixture of two or more if desired.

It is also possible to externally add release agents as previously described.

These additives may be incorporated in the toner composition by internally adding the additives to the toner. In the event of external addition, the additives may be attached to or near the surface of toner particles or dry blended with toner particles. The additives may individually take any of such states depending on their type and purpose.

The toner and external additives may have been treated with organic or inorganic agents, for example, coupling agents such as titanate, aluminum and silane coupling agents and silicone oil for the purposes of rendering the surface hydrophobic and improving surface dispersibility.

The external additives may preferably have a particle diameter of about 0.01 to about 5 μm. They may be blended in an amount of about 0.1 to about 5% by weight based on the weight of the toner.

It is preferred not to externally add the above-mentioned charge control agents, especially metal complexes of azo dyes and Nigrosine dyes.

The magnetic properties of the overall magnetic toner are now described.

The magnetic toner may preferably have a coercive force Hc of 60 to 250 Oe, more preferably 70 to 220 Oe upon magnetization at 5000 Oe, for example. With a Hc of more than 250 Oe, the toner tends to form a hard head resulting in a lower density.

The toner may preferably have a maximum magnetization $\sigma_m$ of 15 to 60 emu/g upon magnetization at 5000 Oe. With a $\sigma_m$ of more than 60 emu/g, the developing performance and density would lower. The toner would readily scatter at a $\sigma_m$ of less than 15 emu/g.

The toner may preferably have a bulk density of from 0.2 to 0.8 g/cm$^3$, more preferably from 0.4 to 0.7 g/cm$^3$ as measured according to JIS Z2504.

The magnetic toner may be prepared in various ways. One exemplary method involves fully mixing stock materials in a Henschel mixer and then milling in a heat melting mill. The mixture is then cooled down, crushed in a hammer mill, and finely divided in a jet impact mill. An extremely fine fraction is removed by an air classifier, an external additive or additives are dry mixed with the mixture in a Henschel mixer, and an extremely coarse fraction is removed by an air classifier. There is obtained a toner having a predetermined particle diameter distribution.

Of course, other well-known prior art methods may be employed.

The carrier and the magnetic toner which are predominant components of the developing composition of the invention have been described. The ratio in maximum magnetization $\sigma_m$ at 5000 Oe of the toner (T) to the carrier (C), that is, $\sigma_{mT}/\sigma_{mC}$ preferably ranges from 0.04 to 2.4, more preferably from 0.08 to 1.7. With a ratio of less than 0.04, it is rather difficult to mix the carrier and the magnetic toner. With a ratio of more than 2.4, a sufficient density would be achieved with difficulty.

The magnetic toner and the carrier are blended to form a developing composition such that the composition initially contains 10% to less than 40% by weight of the carrier. If the initial carrier concentration in the developing composition exceeds 40% by weight, then a substantial lowering is found in consistency of density, fog and resolution upon reproduction of plural copies, especially continuous reproduction of plural copies. If the initial carrier concentration in the developing composition is less than 10% by weight, then the toner tends to agglomerate often resulting in white streaks. Better results are obtained when the initial carrier concentration is in the range of from 12 to 38% by weight, more preferably from 15 to 35% by weight of the developing composition.

Any desired mixer such as a Nauta mixer and V blender may be used to mix the magnetic toner and the carrier.

An electrostatic latent image may be developed with the developing composition described above by the following procedure.

A developing unit is first charged with a predetermined amount of the developing composition containing the carrier in an initial concentration as defined above. The developing unit is preferably of the magnetic brush development type wherein rotation of a magnet magnetically conveys the developing composition to a developing zone.

Preferred developing units are disclosed in Japanese Patent Application Nos. 119935/1979 and 32073/1980, for example, a developing unit comprising a magnet roll and a developing sleeve coaxially enclosing the magnet roll wherein the magnet and the developing sleeve are rotated in the same or opposite directions, and a developing unit comprising a stationary developing sleeve and a rotating magnet roll coaxially received in the sleeve.

FIG. 1 schematically illustrates a developing unit of the magnetic brush development type. The developing unit includes a developing tank 2 for receiving a developing composition 1 therein, a sleeve roll 3, and a magnetic roll 4 coaxially received in the sleeve 3 for free rotation. Relative rotation is induced between the sleeve roll 3 and the magnet roll 4 by rotating either one or both of them. A blade 5 is spaced from the sleeve roll 3 to define a gap between the blade and the sleeve, serving to form a layer of the developing composition on the sleeve roll 3. A photoconductor 6, an arcuate section of which is shown in the figure, is disposed in close facing relationship to the sleeve roll 3. The photoconductor 6 has an electrostatic latent image born thereon. As the photoconductor 6 rotates with respect to the sleeve and magnet rolls 3 and 4 in close relationship, the electrostatic latent image on the photoconductor is developed with the developing composition layer on the sleeve roll.

The benefits of the invention are achieved to the full extent when a developing unit of the magnetic brush type as illustrated above is used.

Besides, the developing composition of the invention is applicable to any other well-known developing systems.

Printing or copying may be commenced once the developing unit is filled with the developing composition. The printing or copying operation consumes only the toner of the composition. Only the toner is made up at intervals whenever the toner concentration is reduced to a predetermined level in the range of 20 to 60% by weight. A consistent image quality is maintained over a number of sheets printed or copied by replenishing only the toner to the developing unit.

The structure and other features of the photoconductor and the printing or copying machine may be of well-known ones.

EXAMPLE

Examples of the present invention are given below by way of illustration and not by way of limitation. In the examples, pbw is part by weight.

EXAMPLE 1

Preparation of Magnetic Toner

| | |
|---|---|
| Composition A | |
| Magnetic powder BL-500 (Titan Industry K.K.) | 55 pbw |
| Styrene-acrylic resin (Nihon Carbide Industry K.K.) | 43.5 pbw |
| Polypropylene 550P (Sanyo Chemicals K.K.) | 2.5 pbw |
| Composition B | |
| Magnetic powder BL-500 (Titan Industry K.K.) | 55 pbw |
| Styrene-acrylic resin (Mitsubishi Rayon K.K.) | 41 pbw |
| Polypropylene 550P (Sanyo Chemicals K.K.) | 5 pbw |
| External additives* | |
| Silica R-974 (Nihon Aerogel K.K.) | 0.8 pbw |
| Zinc stearate 601W (Nitto Chemicals K.K.) | 0.1 pbw |

*per 100 parts by weight of the toner

The ingredients for each of compositions A and B were fully mixed in a Henschel mixer, kneaded in a heat melting mill, cooled down, and crushed in a hammer mill. The mixture was finely divided in a jet impact mill. An extremely fine fraction was removed by an air classifier, the external additives were dry mixed with the mixture in a Henschel mixer, and an extremely coarse fraction is removed by an air classifier. There was obtained a toner A or B having a predetermined particle diameter distribution. Toners A and B both had a volume average particle diameter of 11 μm. Their physical properties are shown below.

TABLE 1

| Physical Properties of Toners | Toner A | Toner B |
|---|---|---|
| Bulk density, g/cm$^3$ | 0.55 | 0.54 |
| Magnetization at 5 kOe, emu/g | 46 | 46 |
| Coercive force at 5 kOe, Oe | 80 | 80 |
| Particle diameter distribution | | |
| Mean particle diameter | 11.0 ± 0.5 μm<br>≦5 μm: up to 0.5%<br>≧20 μm: up to 0.5% | |

| Preparation of Carrier Composition (mol %) |
|---|
| Carrier 1: 16NiO-33ZnO-51$Fe_2O_3$ |
| Carrier 2: 10.5$Mg(OH)_2$-2OZnO-7.5CuO-62$Fe_2O_3$ |
| Carrier 3: 10.5$Mg(OH)_2$-2OZnO-7.5CuO-62$Fe_2O_3$ |

The ingredients for each of Carriers 1 to 3 were added to a mixer, agitated in slurry state, and finely divided in an attritor. The mixture was granulated and dried by means of a spray dryer and baked in an electric furnace. There were obtained stock Carriers 1, 2, and 3. The resistance of stock Carriers 2 and 3 was made different by varying the baking conditions.

Using a sifter and an air classifier, stock Carriers 1, 2, and 3 were classified to several fractions having a mean particle diameter as shown below.

| Carrier | Mean Particle Diameter (μm) |
|---|---|
| 1 | 8, 12, 17, 20, 25, 33, 40 |
| 2 | 8, 13, 17, 22, 25, 35, 40 |
| 3 | 9, 13, 16, 20, 25, 35, 41 |

TABLE 2

| Physical Properties of Carrier | | | | |
|---|---|---|---|---|
| Carrier | Magnetization 5000 Oe, emu/g | Resistance 100 V (DC), Ω | Bulk density, g/cm$^3$ | Stock particle size |
| Stock 1 | 40 | $10^8$ | 2.4 | up to #270 |
| Stock 2 | 70 | $10^7$ | 2.3 | up to #270 |
| Stock 3 | 70 | $10^8$ | 2.3 | up to #270 |

*#270 is a mesh size.

For each of Carriers 1, 2, and 3, a fraction having a mean particle diameter of 25 μm was blended with each of Toners A and B in various initial concentrations using a V blender. There were obtained developing compositions having different initial concentrations of the carrier.

A toner image transfer type electrographic printer machine of the reversal type having a photoconductor in the form of an organic photoconductor (OPC) was charged with each of the developing compositions. The printer includes a developing unit in which a cylindrical developing sleeve is arranged parallel to and spaced a slight gap from a photoconductor drum. A magnet roller adapted to rotate at a high speed is concentrically received in the sleeve for rotation.

The developing sleeve is rotated at a low speed in an opposite direction to the photoconductor drum while the magnet roller within the sleeve is rotated in an opposite direction to the sleeve. A developing bias voltage is applied to the developing sleeve. The developing unit is further provided with an agitator for preventing the toner from agglomerating.

In the developing unit, the developing composition is blended and agitated by the rotation of the developing sleeve so that the toner and the carrier are mutually triboelectrified while the composition is delivered to the circumference of the developing sleeve.

In this printer, electrostatic latent images were developed under the following conditions.

Sleeve roll: 1300×1/7 rpm, diameter 18 mm
Magnet roll: 1300 rpm, 6 poles, surface magnetic flux 700 G
Drum-sleeve gap: 0.30 mm
Blade-sleeve gap: 0.27 mm
Developing bias voltage: −525 V DC
Surface potential: −640 V (OPC drum)

The printer repeated printing operation while the developing unit was charged with the developing composition containing the toner and the carrier in the initial concentration shown in Table 3. The following properties were examined.

1) Carrier Drag-out

The carrier drag-out was determined by continuously printing a solid black pattern on 3 sheets, counting white spots in the printed image on each sheet, and calculating an average number of white spots.

2) Toner Scattering

Printing operation was continued in the printer while scattering toner was visually observed. The composition was rated OK when the toner did not scatter, but NO when the toner scattered.

3) Resolution

Groups of lines at 240 and 300 DPI were printed and visually observed through a 10× magnifier to see whether or not respective lines could be identified independent. The toner passed the test when lines could be identified independent. The final evaluation was made as a combined judgment of both the tests.

| Rating | 300 DPI | 240 DPI |
|---|---|---|
| OK | OK | OK |
| Fair | NO | OK |
| NO | NO | NO |

4) Fog

Using a Reflectometer Model TC-6D manufactured by Tokyo Denshoku K.K., the reflectance (Ri) of a plain paper sheet was measured before printing. After a certain pattern was printed on the paper, the reflectance (Rp) of a non-developed area was measured. The fog is equal to Ri minus Rp, that is, the difference in reflectance before and after printing.

5) White streak

The white streak is a partial break in an image or character on a printed sheet. Agglomerated masses or coarse particles of the developing composition clog in the sleeve-to-blade gap, disturb continuous flow of the developing composition, and thus prevent further delivery of the developing composition onto the sleeve, resulting in breaks in images or characters. Evaluation is made according to the following ratings:

OK: No white streak
Fair: White streaks occurred sometimes, but disappeared later.
NO: At least one white streak appeared at all times.

6) Density variation

The density of a printed image was measured using a Reflectometer Model TC-6D manufactured by Tokyo Denshoku K.K. Provided that Di is the density of an initially printed image and Dp is the density of a subsequently printed image, the maximum density difference $\Delta D = Di - Dp$ was determined.

7) Sleeve adhesion

Continuous printing operation was carried out, the toner was replenished when the toner concentration reached 50% by weight, and further 100 sheets were continuously printed. The sleeve at the surface was blown with air and visually observed to see whether or not agglomerated masses were left on the sleeve. A printed image was also visually observed to see whether or not wavy patterns appeared due to the presence of agglomerated masses. The result was evaluated "NO" when both agglomerated masses and wavy patterns were found, "Fair" when only agglomerated masses were found, and "OK" when neither agglomerated masses nor wavy patterns were found.

8) Fixation

A solid black pattern of 1 by 1 inch was printed on a sheet of plain paper. The resulting solid black image was rubbed with a metallic cylindrical bar (diameter 50 mm and weight 1000 grams) having a piece of gauze attached through double-coated adhesive tape over ten reciprocal strokes. The density of the printed image was measured before and after rubbing.

The percent fixation was calculated according to the following formula:

$$\text{Fixation } (\%) = (Di - Dr)/Di \times 100$$

wherein Di is a density before rubbing and Dr is a density after rubbing.

Among these tests, white streak (5) and density variation (6) are reported in Table 3. These test results were based on continuous printing of 1000 sheets. After an initial image was sampled out, printed images wee sampled out every 200 sheets. A 5% printing pattern in which black character areas totaled to 5 % of the entire surface area was printed during continuous printing except sampling runs when a specially designed test chart was printed.

TABLE 3

| Carrier content, wt % | Tests per 1000 prints: White streak, Toner A | White streak, Toner B | Density variation, Toner A | Density variation, Toner B |
|---|---|---|---|---|
| | | Carrier 1 | | |
| 8 | NO | NO | ≦0.1 | ≦0.1 |
| 12 | Fair | OK | ≦0.1 | ≦0.1 |
| 18 | OK | OK | ≦0.1 | ≦0.1 |
| 23 | OK | OK | ≦0.1 | ≦0.1 |
| 30 | OK | OK | ≦0.1 | ≦0.1 |
| 35 | OK | OK | ≦0.1 | ≦0.1 |
| 40 | OK | OK | 0.18 | 0.17 |
| 50 | OK | OK | 0.25 | 0.23 |
| | | Carrier 2 | | |
| 8 | NO | NO | ≦0.1 | ≦0.1 |
| 12 | Fair | OK | ≦0.1 | ≦0.1 |
| 18 | OK | OK | ≦0.1 | ≦0.1 |
| 23 | OK | OK | ≦0.1 | ≦0.1 |
| 30 | OK | OK | ≦0.1 | ≦0.1 |
| 35 | OK | OK | ≦0.1 | ≦0.1 |
| 40 | OK | OK | 0.17 | 0.16 |
| 50 | OK | OK | 0.22 | 0.21 |
| | | Carrier 3 | | |
| 8 | NO | NO | ≦0.1 | ≦0.1 |
| 12 | OK | OK | ≦0.1 | ≦0.1 |
| 18 | OK | OK | ≦0.1 | ≦0.1 |
| 23 | OK | OK | ≦0.1 | ≦0.1 |
| 30 | OK | OK | ≦0.1 | ≦0.1 |
| 35 | OK | OK | ≦0.1 | ≦0.1 |
| 40 | OK | OK | 0.19 | 0.20 |
| 50 | OK | OK | 0.24 | 0.30 |

For all the combinations of Carriers 1 to 3 with Toners A and B, when the initial carrier concentration is less than 10% by weight, there appear white streaks due to toner agglomeration which is to be eliminated by the present invention. IN turn, if the initial carrier concentration is 40% by weight or higher, the toner is not readily distributed over the carrier when it is replenished as necessitated during continuous printing. As a consequence, a problem arises with respect tot he stability of image density. For this reason, the initial proportion of the carrier in the developing composition should range from 10% to less than 40% by weight.

It is seen that some white streaks occur in those combinations of Carriers 1 and 2 with Toner A. For this reason, the initial proportion of the carrier in the developing composition should preferably range from 15% to 35% by weight.

EXAMPLE 2

An experiment was carried out using carrier fractions having different mean particle diameters. The results are shown in Table 4. The initial carrier concentration was set at 23% by weight of the composition.

TABLE 4

| Carrier fraction, d (μm) | Carrier drag-out, Toner A | Carrier drag-out, B | Toner scattering, Toner A | Toner scattering, B | Resolution, Toner A | Resolution, B |
|---|---|---|---|---|---|---|
| | | | Carrier 1 | | | |
| 8 | 9 | 8 | OK | OK | OK | OK |
| 12 | 0 | ½ | OK | OK | OK | OK |
| 17 | 0 | 0 | OK | OK | OK | OK |
| 20 | 0 | 0 | OK | OK | OK | OK |
| 25 | 0 | 0 | OK | OK | OK | OK |
| 33 | 0 | 0 | OK | OK | Fair | OK |
| 40 | 0 | 0 | NO | NO | NO | NO |
| | | | Carrier 2 | | | |
| 8 | 7 | 5 | OK | OK | OK | OK |
| 13 | 0 | 0 | OK | OK | OK | OK |
| 17 | 0 | 0 | OK | OK | OK | OK |
| 22 | 0 | 0 | OK | OK | OK | OK |

TABLE 4-continued

| Carrier fraction, d (μm) | Carrier drag-out, Toner A | Carrier drag-out, B | Toner scattering, Toner A | Toner scattering, B | Resolution, Toner A | Resolution, B |
|---|---|---|---|---|---|---|
| 25 | 0 | 0 | OK | OK | OK | OK |
| 25 | 0 | 0 | OK | OK | OK | OK |
| 35 | 0 | 0 | OK | OK | OK | OK |
| 40 | 0 | 0 | NO | NO | NO | NO |
| | | | Carrier 3 | | | |
| 9 | 6 | 3 | OK | OK | OK | OK |
| 13 | 0 | 0 | OK | OK | OK | OK |
| 16 | 0 | 0 | OK | OK | OK | OK |
| 20 | 0 | 0 | OK | OK | OK | OK |
| 25 | 0 | 0 | OK | OK | OK | OK |
| 35 | 0 | 0 | OK | OK | OK | OK |
| 41 | 0 | 0 | NO | NO | NO | NO |

For all the combinations of Carriers 1 to 3 with Tones A and B, when the mean particle diameter of the carrier is less than 10 μm, there appear substantial carrier drag-outs. In turn, if the mean particle diameter of the carrier is 40 μm or more, resolution is deteriorated and the machine is soiled with scattering toner. For this reason, the carrier should have a mean particle diameter of 10 to 35 μm.

For the combination of Carrier 1 with Toner A, resolution is somewhat deteriorated at a carrier particle diameter of 33 μm. For the combination of Carrier 1 with Toner B, some carrier drag-outs occurred at a carrier particle diameter of 12 μm. Rather unsatisfactory results are found only in such special combinations. For this reason, the carrier should preferably have a mean particle diameter of 15 to 30 μm.

EXAMPLE 3

A 5% printing pattern was continuously printed on 10,000 sheets of plain paper by charging the printing machine with an initial developing composition consisting of 100 grams of a toner and 30 grams of a carrier having a mean particle diameter of 25 μm, and replenishing 100 grams of the toner whenever a toner indicator was lighted. The toner indicator was adapted to be lighted when the toner concentration reached 50% by weight. The results are shown in Table 5.

The developing compositions used contained a carrier and a toner in the following combinations.

| Developing Composition | |
|---|---|
| Developer 1 | Carrier 1 × Toner A |
| Developer 2 | Carrier 1 × Toner B |
| Developer 3 | Carrier 3 × Toner A |
| Developer 4 | Carrier 3 × Toner B |
| Developer 5 | Carrier 1 × Toner C |
| Developer 6 | Carrier 1 × Toner D |

Carriers 1 and 3 and Toners A and B are the same as in Example 1. Toners C and D are the same as Toners A and B except that Compositions A and B were replaced by the following Compositions C and D, respectively.

| Composition C | |
|---|---|
| Magnetic powder BL-500 (Titan Industry K.K.) | 55 pbw |
| Styrene-acrylic resin (Nihon Carbide Industry K.K.) | 42.5 pbw |
| Polypropylene 550P (Sanyo Chemicals K.K.) | 2.5 pbw |
| Aizen Spilon Black TRH | 1 pbw |

-continued

| | |
|---|---|
| (Hodogaya Chemical K.K.) | |
| Composition D | |
| Magnetic powder BL-500 (Titan Industry K.K.) | 55 pbw |
| Styrene-acrylic resin (Mitsubishi Rayon K.K.) | 41 pbw |
| Polypropylene 550P (Sanyo Chemicals K.K.) | 5 pbw |
| Bontron S-34 (Orient Chemical K.K.) | 1 pbw |

TABLE 5

| Developer | Initial density | At the end of 10000 sheet printing: Density variation | Resolution | Interior Soil | Fog |
|---|---|---|---|---|---|
| 1 | 1.45 | 0.11 | OK | OK | <0.4 |
| 2 | 1.40 | 0.09 | OK | OK | <0.4 |
| 3 | 1.41 | 0.11 | OK | OK | <0.4 |
| 4 | 1.38 | 0.08 | OK | OK | <0.4 |
| 5 | 1.46 | 0.21 | Fair | NO | 0.6 |
| 6 | 1.42 | 0.19 | Fair | NO | 0.6 |

It is seen for the combinations of Carriers 1 and 3 with Toners A and B that the pattern can be consistently reproduced at the end of 10,000 sheet printing without any deterioration of the carrier or any adverse effect on the photoconductor by the developing composition.

In the case of Developers 5 and 6 which were prepared by internally adding charge control agents, Aizen Spilon Black TRH and Bontron S-34, which are monoazo dye chromium complexes, to Toners A and B and blending the toner and the carrier in a carrier concentration of 10 to 40% by weight, the tested properties were poor, especially the machine interior was severely soiled and the background fogging was increased.

Although the foregoing examples refer to negative charge toners, equivalent results are obtained with positive charge toners. In the case of positive charge toners, unsatisfactory results were obtained with a developer having internally added a Nigrosine dye, for example, Bontron N-01 (Hodogaya Chemical K.K.) as the charge control agent.

EXAMPLE 4

Preparation of Magnetic Toner

Toner compositions I to XI as shown in Table 6 were prepared from a magnetic powder, a styrene-acrylic resin (Nihon Carbide Industry K.K.) and polypropylene 550P (Sanyo Chemicals K.K.). Three types of magnetic powder were used:

Magnetic powder A of magnetite having a mean particle diameter of 0.3 μm, a coercive force Hc of 80 Oe and a maximum magnetization $\sigma_m$ of 85 emu/g at 5,000 Oe;

Magnetic powder B of magnetite having a mean particle diameter of 0.5 μm, a Hc of 220 Oe and a $\sigma_m$ of 85 emu/g at 5,000 Oe; and Magnetic powder C of magnetite having a mean particle diameter of 0.2 μm, a Hc of 140 Oe and a $\sigma_m$ of 82 emu/g at 5,000 Oe.

TABLE 6

| Toner | Composition (parts by weight): Magnetic Powder A | B | C | Styrene-acryl | PP |
|---|---|---|---|---|---|
| I | 55 | — | — | 43.5 | 2.5 |
| II | 41.25 | 13.75 | — | 43.5 | 2.5 |
| III | 27.5 | 27.5 | — | 43.5 | 2.5 |
| IV | 13.75 | 41.25 | — | 43.5 | 2.5 |
| V | — | 55 | — | 43.5 | 2.5 |
| VI | 55 | — | — | 41 | 5 |
| VII | 41.25 | 13.75 | — | 41 | 5 |
| VIII | 27.5 | 27.5 | — | 41 | 5 |
| IX | 13.75 | 41.25 | — | 41 | 5 |
| X | — | 55 | — | 41 | 5 |
| XI | — | — | 55 | 43.5 | 2.5 |

| External additives* | |
|---|---|
| Silica R-974 (Nihon Aerogel K.K.) | 0.8 pbw |
| Zinc stearate 601W (Nitto Chemicals K.K.) | 0.1 pbw |

*per 100 parts by weight of the toner

The ingredients for each of compositions I through XI were fully mixed in a Henschel mixer, kneaded in a heat melting mill, cooled down, and crushed in a hammer mill. The mixture was finely divided in a jet impact mill. An extremely fine fraction was removed by an air classifier, the external additives were dry mixed with the mixture in a Henschel mixer, and an extremely coarse fraction is removed by an air classifier. There was obtained a toner having a predetermined particle diameter distribution. Toners I through XI all had a volume average particle diameter of 11 μm. Their physical properties are shown in Table 7.

TABLE 7

| Toner | Bulk density (g/cm$^3$) | Magnetization 5 kOe (emu/g) | Coercive force 5 kOe (Oe) |
|---|---|---|---|
| I | 0.55 | 46 | 80 |
| II | 0.54 | 46 | 120 |
| III | 0.54 | 46 | 145 |
| IV | 0.54 | 46 | 180 |
| V | 0.54 | 46 | 220 |
| VI | 0.54 | 46 | 80 |
| VII | 0.53 | 46 | 120 |
| VIII | 0.53 | 46 | 145 |
| IX | 0.53 | 46 | 180 |
| X | 0.53 | 46 | 220 |
| XI | 0.55 | 45 | 140 |

| Particle diameter distribution | |
|---|---|
| Mean particle diameter | 11.0 ± 0.5 μm<br>≦5 μm: up to 0.5%<br>≧20 μm: up to 0.5% |

For each Carriers 1 and 3 prepared in Example 1, a fraction having a mean particle diameter of 25 μm was blended with each of Toners I through XI using a V blender. There were obtained developing compositions having an initial carrier concentration of 23% by weight.

The printer used in Example 1 having a photoconductor in the form of an organic photoconductive material (OPC) was charged with each of the developing compositions.

The printer repeated printing operation while the developing unit was initially charged with the developing composition containing the toner and the carrier. Tests were carried out to examine line reproduction in the following manner.

Line reproduction

A 1-dot line pattern was printed using a printer having a resolution of 300 DPI. The width W (in μm) of the printed line was measured by taking an enlarged photograph. The ratio of the measured width W to the calculated line width of 85 μm was determined. Whether or not a latent image was faithfully reproduced after fixation was evaluated according to the following ratings.

OK: W/85=0.95-1.10

Fair: W/85=0.85-0.95 or 1.10-1.20

NO: W/85=less than 0.85 or more than 1.20

The results are shown in Table 8.

| Toner | Line reproduction |
|---|---|
| I | NO |
| II | OK |
| III | OK |
| IV | OK |
| V | OK |
| VI | NO |
| VII | OK |
| VIII | OK |
| IX | OK |
| X | OK |
| XI | NO |

The data of Table 8 shows the effectiveness of a mixture of two types of magnetic powder. More particularly, the single use of Magnetic Powder A having a low Hc caused the toner to scatter to the white background near characters and resulted in reduced line reproduction. In contrast, line reproduction control was improved by using a mixture of Magnetic Powders A and B. This improvement is quite unexpected in light of the fact that the single use of Magnetic Powder C having an intermediate Hc between Magnetic Powders A and B resulted in reduced line reproduction.

Furthermore, tone scattering was examined in the same manner as in Example 1. The toners V and X (the single use of Magnetic Powder B having high Hc) increased toner scattering as compared with other toners. Therefore, both line reproduction and toner scattering controlled were improved by using the mixture of Magnetic Powders A and B.

It is to be noted that the developing compositions falling within the scope of the invention were evaluated OK with respect to the resolution of 240 and 300 DPI lines.

According to the present invention, images can be printed on a multiplicity of serially fed sheets with a minimal change of quality including density, fog, and resolution. The benefit is accomplished by excluding such internal additives as metal complexes of axo dyes and Nigrosine dyes from the toner and controlling the initial carrier concentration of the developing composition of the invention can prevent toner agglomeration, while streak formation, carrier drag-out, and toner scattering. A high image density and a high resolution are available with less fog.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

We claim:

1. An electrostatic latent image developing composition comprising a magnetic toner component comprising a powdered agglomeration of magnetic particles and a resin, said magnetic toner component having a mean particle size of 6-25 μm and being free of metal complexes of azo dyes and Nigrosine dyes, said magnetic particles comprising at least two types of magnetic particles having different Hc values; and 10% to about 40% by weight, based on the weight of the initial total developing composition, of a carrier having a mean particle diameter of 15-30 μm.

2. A developing composition of claim 1 wherein said magnetic toner component has $\sigma_m$ of 15-60 emu/g at 5000 Oe, Hc of 60-250 Oe at 5000 Oe, and bulk density of 0.2-0.8 g/cm$^3$; and said carrier has Hc≦50 Oe at 5000 Oe, $\sigma_m$ ≧-220 emu/g at 5000 Oe, electric resistance ≧$2\times10^5$ Ω and bulk density of 2.1-3.3 g/cm$^3$.

3. The developing composition of claim 1 wherein the magnetic toner component contains 0.1 to 5% weight, based on the weight of the agglomerated toner component, of external additives selected from the group consisting of resistance modifiers, tone control agents, coloring agents and flow modifiers.

4. The developing composition of claim 1 wherein said magnetic particles have a mean particle diameter of from 0.01 to 10 μm.

5. A method for developing an electrostatic latent image using a developing unit including a magnet, a developing sleeve mounted for relative rotation on the magnet, and a photoconductor disposed in proximity to the sleeve and adapted to have a latent image born thereon comprising the steps of:

contacting a photoconductor which has an electrostatic latent image with a developing unit having a developing composition, said composition comprising a magnetic toner component comprising a powdered agglomeration of magnetic particles and a resin, said magnetic toner component having a mean particles size of 6-25 μm and being free of metal complexes of azo dyes and Nigrosine dyes, said magnetic particles comprising at least two types of magnetic particles having different Hc values; and 10% to about 40% by weight, based on the weight of the initial total developing composition of a carrier having a mean particle diameter of 15-30 μm; and causing relative rotation of the magnet and the developing sleeve, thereby developing the latent image on the photoconductor with the developing composition.

6. The method of claim 5 which further includes replenishing only the magnetic toner component.

7. The method of claim 6 wherein the magnetic toner component is replenished when the concentration of said carrier is increased to 20 to 60% by weight based on the entire composition.

8. The method of claim 5, wherein the magnetic toner component contains 0.1 to 5% weight, based on the weight of the agglomerated toner component, of external additives selected from the group consisting of resistance modifiers, tone control agents, coloring agents and flow modifiers.

9. The method of claim 5 wherein said magnetic toner component has $\sigma_m$ of 15-60 emu/g at 5000 Oe, Hc of 60-250 Oe at 5000 Oe, and bulk density of 0.2-0.8 g/cm$^3$; and said carrier has Hc ≦50 Oe at 5000 Oe, $\sigma_m$ 25-220 emu/g at 5000 Oe, electric resistance ≧$1\times10^5$ Ω and bulk density of 2.1-2.3 g/cm$^3$.

* * * * *

UNITED STATES PATENT AND TRADEMARK OFFICE

CERTIFICATE OF CORRECTION

PATENT NO. : 5,260,160

DATED : November 9, 1993

INVENTOR(S) : Aoki, et al

It is certified that error appears in the above-indentified patent and that said Letters Patent is hereby corrected as shown below:

Column 18, line 17, "$\sigma_m \simeq -220$" should read --$\sigma_m 25-220$--;

Column 18, line 18 "$\geq 2-10^5\Omega$" should read $\geq 1 \times 10^5\ \Omega$ Signed and Sealed this Twelfth Day of July, 1994

*Attest:*

*Attesting Officer*

BRUCE LEHMAN

*Commissioner of Patents and Trademarks*